US006352080B1

(12) United States Patent
Neville

(10) Patent No.: US 6,352,080 B1
(45) Date of Patent: Mar. 5, 2002

(54) MICROWAVABLE HAIR CURLER

(76) Inventor: Karen Neville, 1205 Elsing Rd., Baltimore, MD (US) 21221

( * ) Notice: Subject to any disclaimer, the term of this patent is extended or adjusted under 35 U.S.C. 154(b) by 0 days.

(21) Appl. No.: 09/680,432

(22) Filed: Oct. 6, 2000

(51) Int. Cl.[7] ..... A45D 1/20; A45D 1/02; A45D 2/06

(52) U.S. Cl. ..... 132/233; 132/267; 132/227

(58) Field of Search ..... 132/233, 220, 132/227, 229, 267, 236, 241, 226, 240, 243, 264, 148, 262; 219/759

(56) References Cited

U.S. PATENT DOCUMENTS

| | | | | | |
|---|---|---|---|---|---|
| 4,041,961 | A | * | 8/1977 | Shaler et al. | 132/233 |
| 4,164,951 | A | * | 8/1979 | Shaler et al. | 132/233 |
| 4,502,496 | A | * | 3/1985 | Thomas et al. | 132/233 |
| 4,538,630 | A | | 9/1985 | Henderson | 132/33 R |
| 4,687,010 | A | | 8/1987 | Caruso | 132/33 R |
| 4,710,609 | A | | 12/1987 | Switlicki | 219/222 |
| 5,030,820 | A | | 7/1991 | Gibbon | 219/10.55 R |
| D332,155 | S | | 12/1992 | Wistrand | D28/38 |
| 5,286,949 | A | | 2/1994 | Simons | 219/222 |
| 5,819,763 | A | | 10/1998 | Hallowell, II | 132/247 |
| 5,988,182 | A | | 11/1999 | Engelbrecht | 132/262 |
| 6,064,051 | A | | 5/2000 | Gray | 219/759 |
| 6,074,415 | A | | 6/2000 | Der Ovanesian | 607/114 |
| 6,079,422 | A | | 6/2000 | Drago et al. | 132/247 |

* cited by examiner

*Primary Examiner*—John J. Wilson
*Assistant Examiner*—Robyn Kieu Doan
(74) *Attorney, Agent, or Firm*—Stevens, Davis, Miller & Mosher, LLP

(57) ABSTRACT

A microwave heatable hair curler comprised of a pair of rigid, hollow, concentric cylinders sealed at both ends to create an annular space therebetween, with a heat absorbant material contained in this annular space. The gel is capable of being heated in a microwave oven to a hair curling temperature and capable of maintaining such temperature for a time sufficient for hair curling to take place. The gel contains a biocide so that it can be permanently sealed in the curler.

7 Claims, 2 Drawing Sheets

MICROWAVABLE HAIR CURLER

BACKGROUND OF THE INVENTION

1. Field of the Invention

This invention relates to hair curling devices which are rapidly heated in microwave ovens and retain heat for a prolonged time. Specifically, the invention deals with gel-filled curler spools containing a gel which can be effectively heated to hair curling temperatures when exposed to microwaves for a very short time and then retain hair curling temperatures for a prolonged time period sufficient to curl hair 2. Description of Related Art Hair curlers are known for use in drying and curling hair and have been provided in a variety of configurations. Generally, the prior art curlers have comprised molded cylinders or spools of heat transmissive materials such as plastic, which were heated by steam or hot water or which had hollow cores which were fitted around electrically heated rods. Other prior art heated curlers were formed as flexible rod-like bodies which could be bent over themselves to retain a hair tress wound thereon. See, for example, U.S. Pat. No. 4,584,462, issued Apr. 22, 1986, to Morrison. These prior known hair winders or spools required a lengthy pre-heat time before reaching operating temperatures. They also required specialized heating equipment such as steam generators or electrical finger heaters for receiving the spools, and the like.

Microwaveable hair curlers that require no specialized heating equipment are also known. A standard microwave is used to heat an energy retaining material, that is an integral part of the hair curler, to a hair curling temperature. This microwave heating is accomplished more quickly than otherwise.

U.S. Pat. No. 5,988,182 to Engelbrecht discloses microwave heatable rigid cylinders with an annular volume between them containing a granular energy retaining material sealed therein. U.S. Pat. No. 6,079,422 to Drago, see FIGS. 1*a*–1*c*, discloses a microwaveable flexible hollow tube, the interior of which contains a granular heat absorbant material 10. FIG. 1*a* illustrates an end-view of a curler containing a granular heat absorbant material in an annular volume while FIG. 1*c* illustrates a cross-sectional view of this curler. U.S. Pat. No. 6,064,151 to Gray discloses a microwaveable hair curler consisting of a rigid supporting member for a gel-containing, moisture-emitting and moisture-absorbing sheath, the gel comprising a humectant, water, and a crosslinked water soluble polymer (gel).

Thus, both flexible and rigid forms of microwaveable curlers incorporating a separate heat absorbant material are known. Their energy retaining materials have ranged from cereal grain to moisture-emitting-absorbing gels. However, these devices have been subject to loss or degradation of their energy retaining material through contamination, leakage or wear-out from exposure to microwave energy. In response, prior art curlers have been adapted to enable replacement of their heat absorbing materials.

It would therefore be an improvement in this art to provide microwave heated hair curlers or winders which incorporate long-lived, i.e., effectively permanent, heat absorbant materials.

SUMMARY OF THE INVENTION

According to the current invention, there is provided microwave heatable hair winder devices formed from two concentric cylinders with a cellulose, polyacrylic acid, or gum based gel in the annulus between the cylinders and having a hollow core, as illustrated in FIG. 2. The ends of the cylinders are capped to permanently close in, i.e., seal in, the gel. The gel formed from these gel-forming materials and water is highly viscous in the preferred embodiment of the current invention. A biocide also is included in this gel to prevent mold growth and resultant degradation. The gel is heated by microwaving and retains heat for a sufficiently long time such that the invention can be employed as a heated hair curler.

The curlers of the current invention are preferably in the form of hollow molded plastic material spools with cylindrical surfaces around which hair is easily wound. These curlers are made of a heat conductive plastic material that is transparent to microwaves, having a softening point well above hair drying and curling temperature, and which may be comfortably grasped when winding hair around the heated cylindrical portion. A pin 30 is the preferred means for retention of a wound curler, as illustrated in FIG. 3. Prior art retention means have included such pins as well as hair-catching fingers on the outer surface of curlers, as illustrated in FIG. 1*b*.

Thus, the curlers of the present invention overcome the disadvantages of the energy retaining materials of the prior art, namely, degradation of these materials with use and elapse of time. Also, because the gel is permanently sealed-in the energy absorbing material will not leak out or ever need to be replaced during the useful lifetime of the curler.

BRIEF DESCRIPTION OF THE DRAWINGS

Other objectives, features, and advantages of the present invention will become more fully apparent from the following detailed description of the preferred embodiments and as depicted in the accompanying drawings.

DESCRIPTION OF THE PREFERRED EMBODIMENTS

Figure 1A:
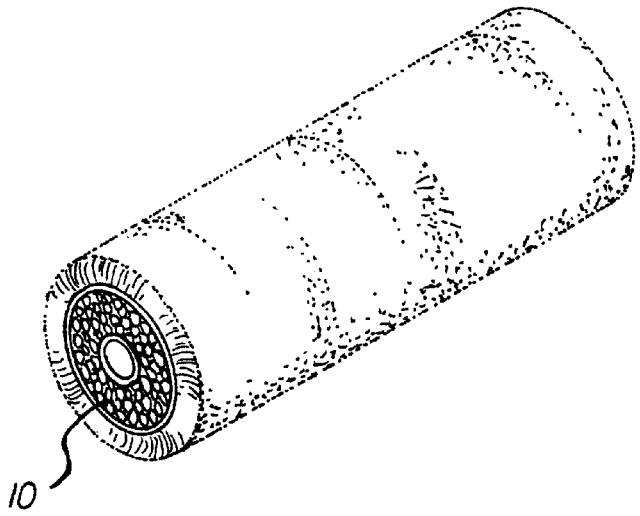
FIG. 1a (PRIOR ART)
FIG. 1*a* illustrates an end view of a rigid cylindrical curler incorporating an annulus containing a granular heat absorbing material and having a surface with hair catching fingers, according to the prior art.
Figure 1B:
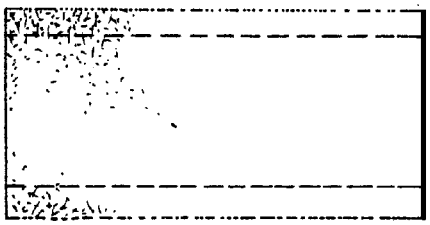
FIG. 1b (PRIOR ART)
FIG. 1*b* illustrates a curler having a surface with hair-catching fingers for retaining a wound curler, according to the prior art.
Figure 1C:
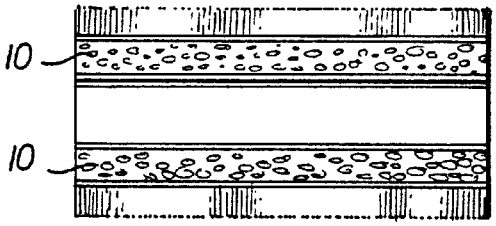
FIG. 1c (PRIOR ART)
FIG. 1*c* is a cross-sectional view of a rigid cylindrical curler incorporating an annulus containing a granular heat absorbing material as well as a surface with hair catching fingers, according to the prior art.
Figure 2:
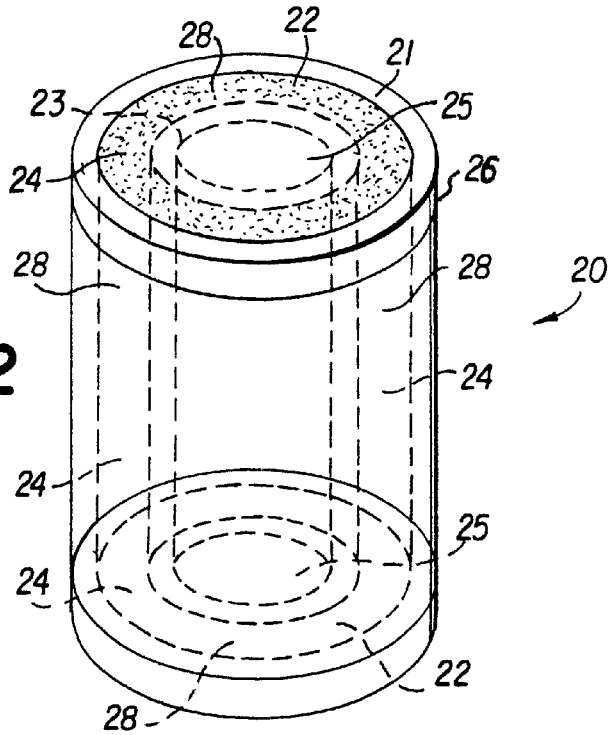
FIG. 2 illustrates a curler according to a preferred embodiment of the present invention.
Figure 2A:
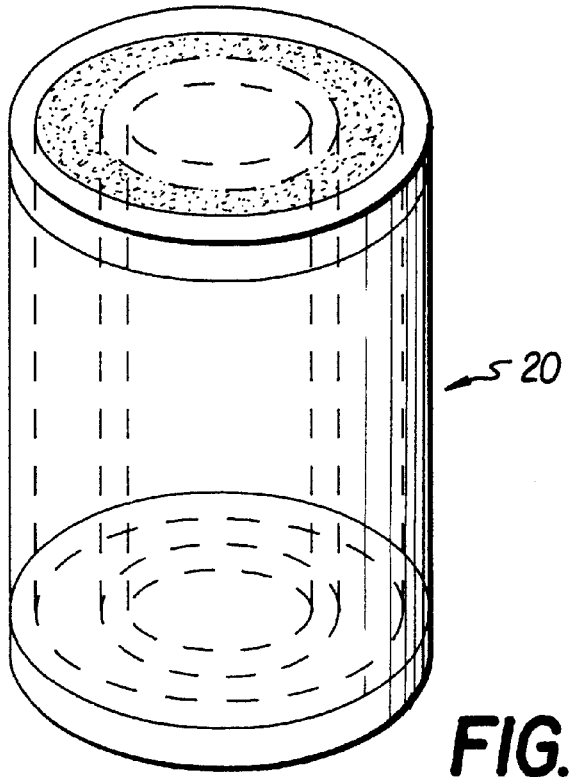
FIG. 2A illustrates the embodiment of FIG. 2 with less labeling to better see its features.

FIG. 2 illustrates a preferred embodiment 20 of a microwave heatable hair curler according to the present invention. The curler 20 includes an outer hollow plastic cylinder 21 and an inner hollow plastic cylinder 23. Both the outer cylinder 21 and the inner cylinder 23 have open ends 22 and 25, the outer cylinder 25 shown having a smooth continuous outer surface with no protrusions or gaps. The open ends 22 and 25 are closed-in, i.e., sealed, by a pair of sealing disks 26, 27 located at each end of the concentric cylinders.

The cylinders 21, 23 and the sealing disks 26, 27 define an annular volume or space 24 located between the outer and inner cylinders 21, 23 which annular space 24 is essentially sealed. The annular space contains a heat absorbing gel 28. The curler 20 includes a heat absorbing gel 28 disposed in the annular volume 24.

The cylinders 21, 23 are formed of a polymeric or plastic material which is able to withstand exposure to microwave energy for periods of up to several minutes without loss of integrity or becoming brittle. Typical plastics include polypropylene, polycarbonate, etc.

Gels which absorb heat energy can be formed from cellulose derivatives, neutralized polyacrylic acids, and gums. In a preferred embodiment the cellulose derivative used for the gel 28 comprises sodium carboxymethycellulose (sodium CMC), hydroxyethylcellulose or hydroxypropylcellulose and water. In another preferred embodiment the gum used for the gel 28 is xanthan gum or guar gum and water. Regardless of which chemical is selected to create the gel, the gel 28 further incorporates a biocide, such as methyl paraben or propyl paraben, to prevent mold and resultant degradation. In this way the gel 28 can be permanently sealed in the annular space 24.

The cylinders 21,23 are sealed and preferably made of water impervious plastic. Thus, the resulting hair curlers emit a dry heat.

Figure 3:
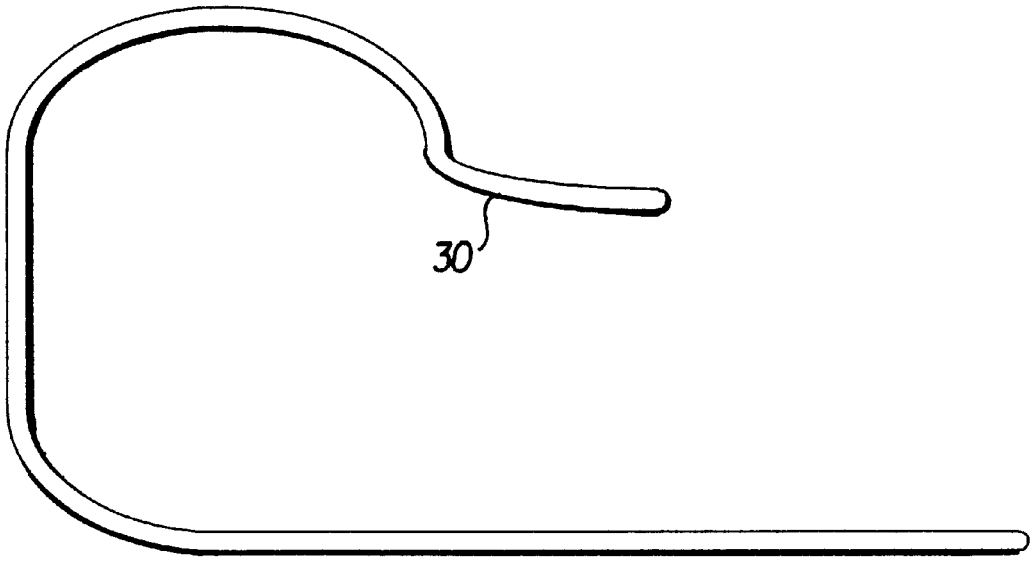
FIG. 3 illustrates a clip for use with the embodiment of FIG. 2.

Referring now to FIG. 3, a curler wound with hair is retained by means of a clip 30 which is sized to surround the wound curler and adapted to be slidably insertable around the wound curler.

Typically, the curlers of the present invention are used by heating them in a microwave until they have a desired amount of heat, rolling them into hair and clipping them into place. Due to their dry polymeric surface they emit a dry heat. Dry heat treatment of hair is a desirable in many instances. For example, a curling iron emits dry heat in a useful manner.

From the foregoing it will be obvious to one skilled in the art that numerous modifications and variations can be made without departing from the spirt and scope of the novel aspects of the current invention. It is to be understood that no limitation with respect to the specific embodiments illustrated is intended or should be inferred.

What is claimed is:

1. A microwave heatable hair curler comprising:

(a) an elongated hollow outer plastic cylinder having both ends open and a inner diameter;

(b) an elongated inner plastic cylinder having a length at most equal to said outer cylinder, having both ends open, having an outer diameter that is less than said inner diameter, having said inner plastic cylinder inserted into said outer plastic cylinder such that said outer and inner cylinders are concentric and the gap created between said cylinders is uniform in width;

(c) a pair of sealing disks equal in diameter to said outer diameter and having said sealing disks placed at both open ends of said outer cylinder containing said inner cylinder and having both ends sealed thereby creating a sealed annular space between said outer cylinder and said inner cylinder; and (d) an amount of microwave heatable gel containing a biocide having said gel completely fill said annular space.

2. The microwave heatable hair curler according to claim 1, wherein said gel further comprises:

(a) water; and (b) a chemical selected from the group consisting of sodiumcaraboxymethylcellulose, polyacrylic acid, hydroxyethylcellulose, hydroxypropylcellulose, xanthan gum, and guar gum.

3. The microwave heatable hair curler according to claim 1, wherein said gel further comprises a biocide selected from the group consisting of methyl paraben and propyl paraben.

4. The microwave heatable hair curler according to claim 1, wherein said hollow outer plastic cylinder has a smooth continuous outer surface with no protrusions protruding from the outer surface.

5. The microwave heatable hair curler according to claim 1, wherein said sealing disks are permanently fixed to said cylinders to permanently seal said annular space.

6. The microwave heatable hair curler according to claim 1 further comprising a clip having said clip sized to surround said hair curler and adapted to be slidably insertable around said hair curler after hair is wound around said hair curler.

7. A method of curling hair, comprising:

heating the hair curler of claim 1;

rolling the heater hair curler into hair;

clipping the rolled hair curler into place; and emitting dry heat from the clipped hair curler into the hair.

* * * * *